US010294655B2

(12) United States Patent
Murphy, III et al.

(10) Patent No.: US 10,294,655 B2
(45) Date of Patent: May 21, 2019

(54) FILTRATION APPARATUS FOR USE WITH DRAINAGE STRUCTURES AND METHOD FOR INSTALLING THE SAME

(71) Applicants: John E. Murphy, III, Mobile, AL (US); David A. Jones, Theodore, AL (US); William J. MacWilliam, Mobile, AL (US)

(72) Inventors: John E. Murphy, III, Mobile, AL (US); David A. Jones, Theodore, AL (US); William J. MacWilliam, Mobile, AL (US)

( * ) Notice: Subject to any disclaimer, the term of this patent is extended or adjusted under 35 U.S.C. 154(b) by 0 days.

(21) Appl. No.: 15/443,906

(22) Filed: Feb. 27, 2017

(65) Prior Publication Data

US 2017/0247873 A1 Aug. 31, 2017

Related U.S. Application Data

(60) Provisional application No. 62/389,490, filed on Feb. 29, 2016.

(51) Int. Cl.

| | |
|---|---|
| ***E03F 5/06*** | (2006.01) |
| ***E03F 5/14*** | (2006.01) |
| ***E03F 5/04*** | (2006.01) |

(52) U.S. Cl.

CPC ..... *E03F 5/14* (2013.01); *E03F 5/0404* (2013.01); *E03F 5/06* (2013.01); *E03F 2005/061* (2013.01)

(58) Field of Classification Search

CPC ... E03F 5/0404; E03F 5/06; E03F 5/14; E03F 2005/061

USPC ..... 210/162, 163, 164, 170.03, 747.3

See application file for complete search history.

(56) References Cited

U.S. PATENT DOCUMENTS 571,711 A * 11/1896 Twist ..... E04D 13/0645 210/162
2,305,955 A * 12/1942 Dudley ..... E03F 5/06 210/163
5,864,990 A * 2/1999 Tu ..... E03F 5/06 210/163

(Continued)

FOREIGN PATENT DOCUMENTS

EP 2468969 * 6/2012
FR 2292804 * 6/1976

OTHER PUBLICATIONS

Machine translation of FR 2292804, Jun. 1976.*
Machine translation of EP 2468969 Jun. 2012.*

*Primary Examiner* — Christopher Upton
(74) *Attorney, Agent, or Firm* — AdamsIP, LLC; Gary N. Stewart; Stephen Thompson

(57) ABSTRACT

A filtration apparatus for use with drainage structures and a method for installing the same are provided. The filtration apparatus has a first grate and a second grate, which, when installed and secured together, establish a filtration barrier between the inlet and bottom of a drainage structure for filtering stormwater runoff entering the drainage structure. The first grate and second grate are secured to internal walls of the drainage structure via anchoring members. The anchoring members allow each of the grates to rotate to facilitate transition of each grate from a hanging to a suspended position. A connecting member secures the first grate and the second grate together so that the grates bisect the cavity of the drainage structure.

19 Claims, 5 Drawing Sheets

(56) References Cited

U.S. PATENT DOCUMENTS

| | | | | |
|---|---|---|---|---|
| 5,954,952 | A * | 9/1999 | Strawser, Sr. | B01D 29/01 210/164 |
| 7,144,185 | B2 * | 12/2006 | Messerschmidt | E03F 5/06 210/164 |
| 7,637,695 | B1 * | 12/2009 | Akkala | E03F 5/06 404/4 |
| 9,057,189 | B2 * | 6/2015 | Flury | E03F 5/14 |
| 2007/0295652 | A1 * | 12/2007 | Kent | E03F 5/0404 210/164 |
| 2009/0107053 | A1 * | 4/2009 | Guilford | E04D 13/0643 210/162 |
| 2010/0025312 | A1 * | 2/2010 | Martin | E02B 5/085 210/170.03 |

* cited by examiner

FILTRATION APPARATUS FOR USE WITH DRAINAGE STRUCTURES AND METHOD FOR INSTALLING THE SAME

CROSS-REFERENCE TO RELATED APPLICATIONS

This application claims priority to U.S. Provisional Patent Application No. 62/389,490, entitled "A Method to Separate Debris and Other Contaminants from Stormwater Runoff in Both New and Retrofit Applications," filed Feb. 29, 2016, which application is incorporated herein in its entirety.

FIELD OF THE DISCLOSURE

The subject matter of the present disclosure refers generally to a filtration device for use with drainage structures and a method of installing the same.

BACKGROUND

Stormwater runoff occurs when stormwater generated from precipitation or melting events contacts a surface impervious to liquids, such as paved roadways, or when an absorbent surface becomes fully saturated. Unless diverted or drained, excess stormwater runoff buildup on such impervious surfaces can lead to severe flooding. To guard against flooding due to stormwater runoff, storm sewers have long been used to drain and subsequently divert stormwater runoff. Generally, storm sewers comprise a drainage structure that serves as the entryway for stormwater runoff to enter the storm sewer and a piping or channeling system attached thereto that subsequently transports the stormwater runoff from the drainage structure to a water body such as a canal, river, lake, reservoir, sea, ocean, etc. Drainage structures often receive stormwater runoff through either a horizontal inlet, such as with roadway drains, or a vertical inlet, such as with curbside drains. To separate out debris and contaminants from the stormwater runoff, inlet grates configured to rest upon or cover the inlet of the drainage structure are often used. Such inlet grates typically have a series of openings disposed therein that serve to prevent debris exceeding the diameter of the grate openings from entering the drainage structure. However, inlet grates typically used within the art often prove largely insufficient during periods of heavy stormwater runoff and are burdensome when access to the cavity of the drainage structure is needed.

Typically, inlet grates are manufactured to rest over the inlet of the drainage structure such that the stormwater runoff must first contact or pass through the grate before entering the cavity of the drainage structure. Accordingly, debris blockaded by the inlet grate will often either remain on the grate or be propelled off of the grate due to the force of the inflowing stormwater runoff. Both outcomes are problematic. If the debris remains on the grate, the debris may clog the openings of the grate, thereby impeding the flow and ultimately reducing the volume of stormwater runoff that may enter the drainage structure. If debris is propelled off of the grate, the debris effectively litters the environment surrounding the drainage structure. Moreover, because conventional inlet grates are generally manufactured as a unitary piece of cast iron they are often extremely heavy and cannot be disassembled. Accordingly, to access the bottom of the drainage structure and/or the piping or channel system attached thereto, an individual or machine must initially lift the heavy grate from the inlet to gain access and subsequently place the grate back on the inlet to reseal the drainage structure. Thus, due to the weight of the inlet grate, a great deal of strenuous force must be exerted to remove and subsequently replace the inlet grate which can potentially injure the individual or damage the machine carrying out such actions.

Accordingly, a need exists in the art for a filtration apparatus and method for use with drainage structures that captures debris from stormwater runoff without impeding or reducing the volume of stormwater runoff that may enter the drainage structure. Moreover, there is a need in the art for a filtration apparatus for use with drainage structures that can be easily manipulated to provide simple access to the bottom of the drainage structure.

SUMMARY

In one aspect, a filtration apparatus for use with drainage structures is provided. The filtration apparatus is designed for installation within a drainage structure to provide a filtration device in place of, or in addition to, pre-existing filters within the structure. The filtration apparatus comprises a first grate and a second grate, which, when installed and secured, establish a physical barrier between the inlet and the bottom of a drainage structure. Each grate has a plurality of openings therein to filter incoming stormwater runoff such that stormwater runoff may pass through the openings while debris having dimensions greater than the openings are caught on the grate. Each grate has a proximal side and a distal side. The proximal side of the first grate and the proximal side of the second grate are secured to a first anchoring member and to a second anchoring member, respectively. Each anchoring member is secured to a respective internal wall of the drainage structure. Once each grate is secured to its respective anchoring member, the distal side of the first grate is secured to the distal side of the second grate via a connecting member, which establishes a filtration barrier between the inlet and the bottom of the drainage structure.

Because the anchoring members allow the grates to be secured to the internal walls of a drainage structure, the filtration apparatus of the present disclosure may be secured within the cavity of the drainage structure below the inlet. Accordingly, because the filtration apparatus may be positioned below the inlet of the drainage structure, debris may be permitted entry into the drainage structure where the debris is subsequently caught by the filtration apparatus. Thus, the filtration apparatus in conjunction with the internal walls of the drainage structure prevents debris from being carried into the surrounding environment once filtered.

In a preferred embodiment, the widths of the first grate and the second grate are such that when installed within the drainage structure and secured together, each grate angles downwardly from its proximal side to its distal side towards the center of the drainage structure. To achieve this end, the combined width of the first grate and second grate may be greater than the width of the drainage structure. By securing the grates in an angled, fixed position, debris caught by the filtration apparatus is directed and subsequently accumulates about the center of the filtration apparatus within the center of the drainage structure. Because stormwater runoff is not generally projected towards the center of the drainage structure upon entry, angling the grates in this manner serves to reduce or prevent filtered debris from blocking the flow of stormwater runoff.

To facilitate access to the cavity of the drainage structure without having to completely remove the filtration apparatus, the filtration apparatus may be set in an open configuration or in a closed configuration. In a closed configuration, the first grate and the second grate are secured to each other, thereby establishing a physical barrier between the inlet and the bottom of the drainage structure. In an open configuration, the first grate and second grate are not secured together such that each grate may freely hang within the drainage structure about its respective anchoring member. To change from one configuration to another, the first and second anchoring members are preferably configured to permit the first and second grate, respectively, to rotate from an open position to a closed position, or vice versa. In another preferred embodiment, the connecting member is a hook that removably secures the first and second grate together by receiving the distal side of the second grate therein. Thus, by removing the distal side of the second grate from the hook or by placing the distal side of the second grate within the hook, the filtration apparatus can be set in a closed or an open configuration, respectively.

The foregoing summary has outlined some features of the apparatus and methods of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the device and methods disclosed herein. Those skilled in the pertinent art should also realize that such equivalent designs or modifications do not depart from the scope of the device and methods of the present disclosure.

DESCRIPTION OF DRAWINGS

These and other features, aspects, and advantages of the present disclosure will become better understood with regard to the following description, appended claims, and accompanying drawings where:

DETAILED DESCRIPTION

Figure 1:
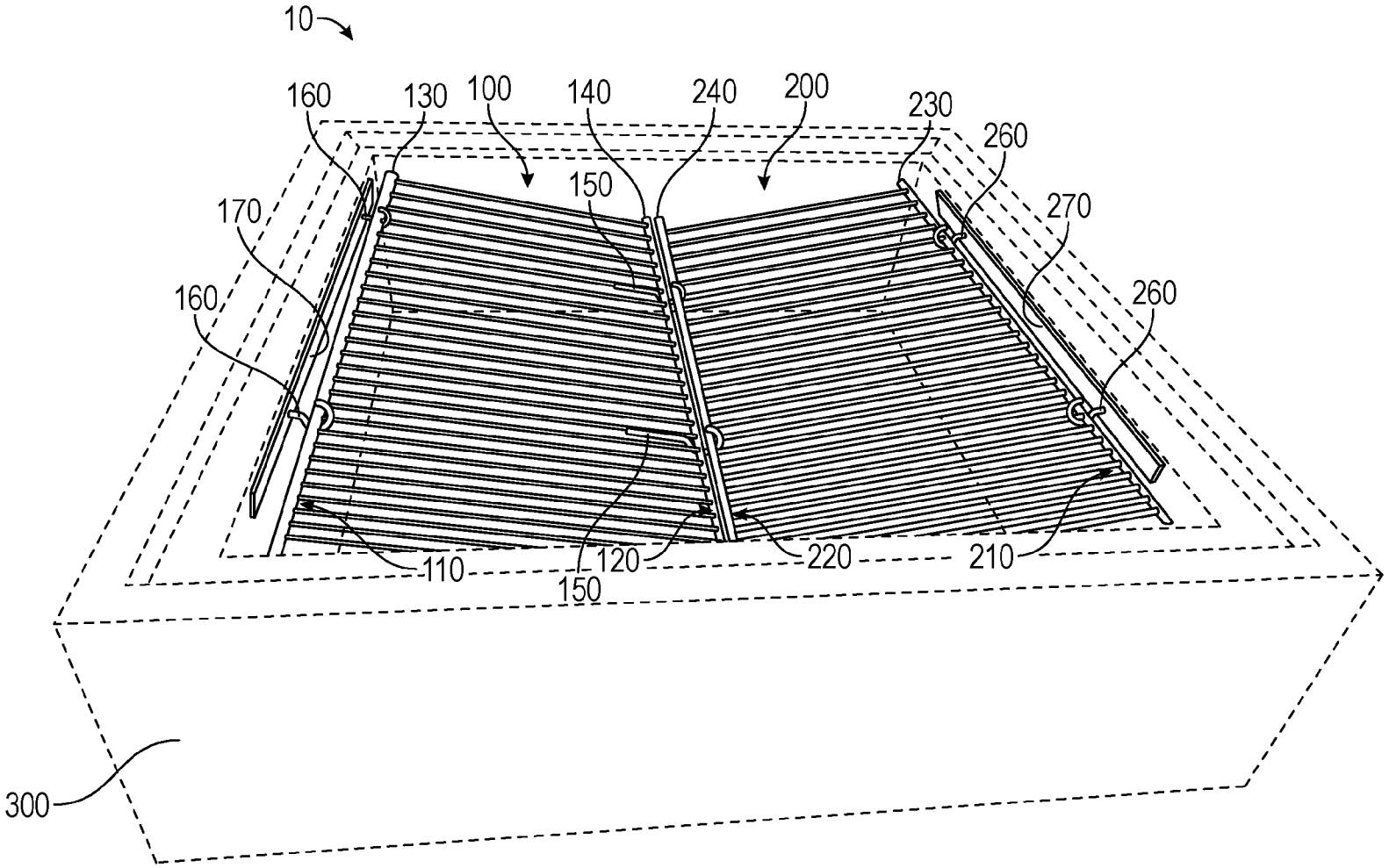
FIG. 1 shows a perspective view of a filtration apparatus embodying features consistent with the principles of the present disclosure installed in a drainage structure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility). The term "removably secured" and grammatical equivalents thereof are used herein to mean the joining of two components in a manner such that the two components are secured together, but may be detached from one another without requiring the use of specialized tools. As used herein, the term "inlet" and grammatical equivalents thereof are understood to mean an opening within a drainage structure designed to permit entry of stormwater runoff from an external environment into the cavity of the drainage structure.

Turning now to the drawings, FIGS. 1-8 illustrate preferred embodiments of a filtration apparatus, or various components thereof, for use with drainage structures. The filtration apparatus 10 is designed to establish a physical barrier between the inlet and bottom of a drainage structure 300 when installed and set in a closed configuration. The filtration apparatus 10 has a first grate 100 having a proximal side 110 and a distal side 120, and a second grate 200 having a proximal side 210 and a distal side 220. The first and second grate 100, 200 each have a plurality of openings therein to separate debris from stormwater runoff flowing through the drainage structure 300. The first grate 100 and second grate 200 are positioned within the interior of a drainage structure 300 in order to filter debris from stormwater or other water sources passing through the drainage structure 300. The proximal side 110 of the first grate 100 and the proximal side 210 of the second grate 200 are secured to a first anchoring member 160 and to a second anchoring member 260, respectively. The first anchoring member 160 is configured to secure the first grate 100 to a first internal wall of the drainage structure 300, and the second anchoring member 260 is configured to secure the second grate 200 to a second internal wall of the drainage structure. In a preferred embodiment, the first and second anchoring members 160, 260 are configured to permit the first grate 100 and the second grate 200 to rotate thereupon, respectively, such that the grates may rotate from a generally vertical position to a generally horizontal position within the drainage structure 300. Once secured to the first and second anchoring members 160, 260, the distal side 120 of the first grate 100 may be secured to the distal side 220 of the second grate 200 via a connecting member 150.

When the grates are secured together, the filtration apparatus 10 retains a closed configuration such that the first grate 100 and second grate 200 establish a physical barrier that bisects the cavity of the drainage structure 300. The first and second grate 100, 200 both have a plurality of openings therein that permit stormwater runoff to pass through the grates while filtering debris 320. The connecting member 150 is preferably configured to removably secure the first and second grate 100, 200 together such that the grates may be changed from a closed configuration to an open configuration. When in an open configuration, the first grate 100 and the second grate 200 do not bisect the cavity of the drainage structure 300.

Figure 2:
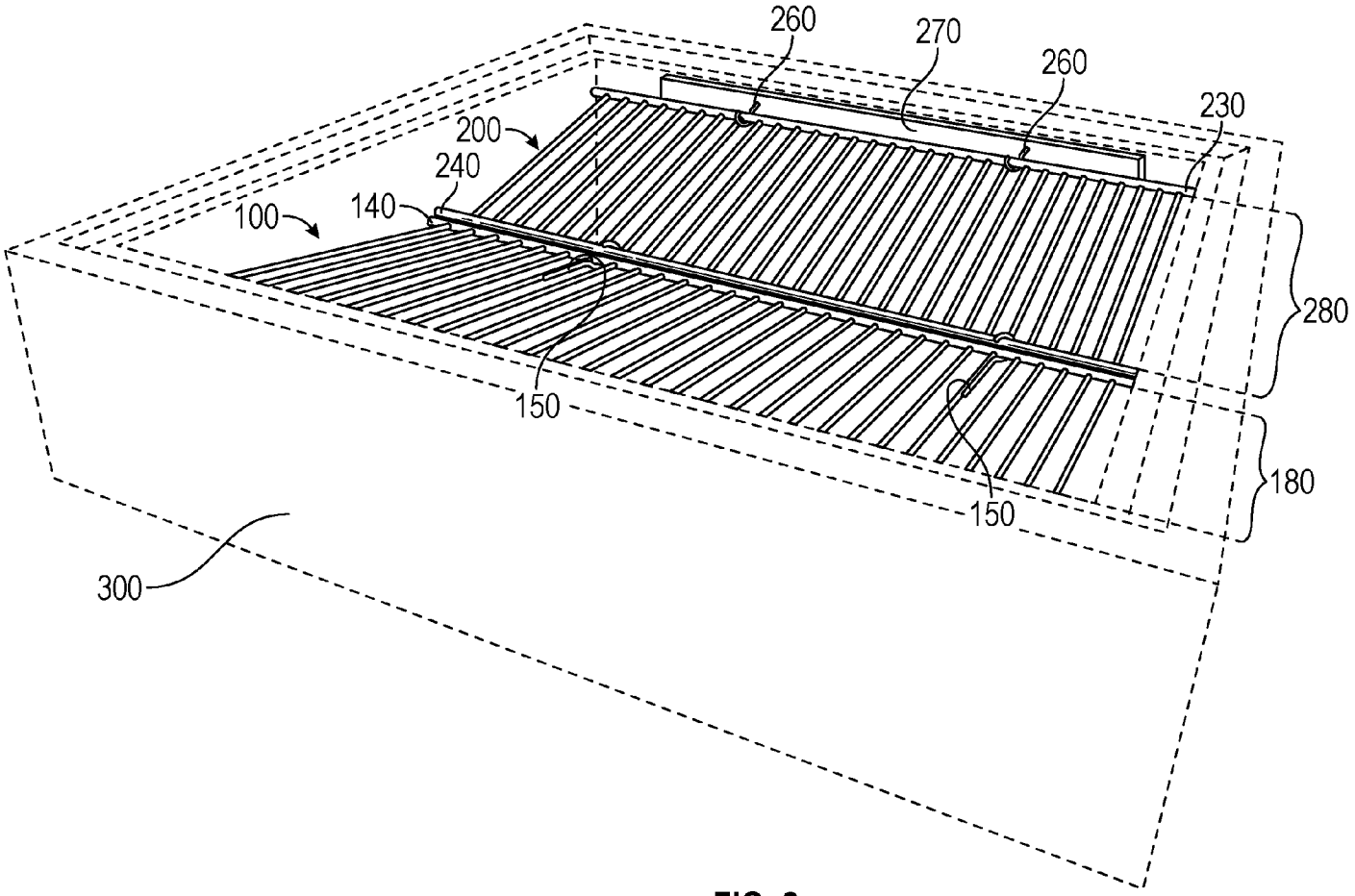
FIG. 2 shows a perspective view of a filtration apparatus embodying features consistent with the principles of the present disclosure installed in a drainage structure.
Figure 3:
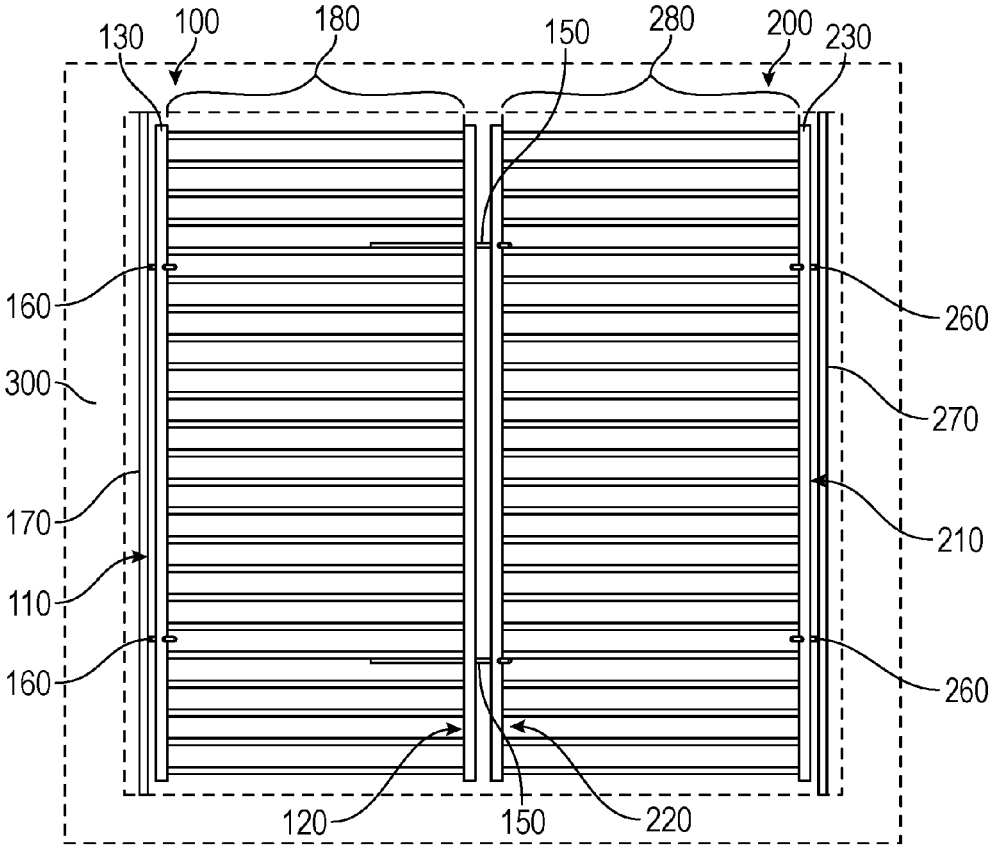
FIG. 3 shows a top plan view of a filtration apparatus embodying features consistent with the principles of the present disclosure.

As shown in FIGS. 1-3, the filtration apparatus 10 generally comprises a first grate 100, a second grate 200, a connecting member 150 configured to secure the first grate 100 to the second grate 200, a first anchoring member 160 configured to secure the first grate 100 to a first internal wall of a drainage structure 300, and a second anchoring member 260 configured to secure the second grate 200 to a second internal wall of the drainage structure 300. The first grate 100 has a proximal side 110 and a distal side 120, and the second grate 200 has a proximal side 210 and a distal side 220. As used herein, the "proximal side" of a grate refers to the side of a grate that is secured to an internal wall of a drainage structure 300 in the manner disclosed herein. The "distal side" as used herein refers to the side of the grate opposite of the proximal side.

Figure 4:
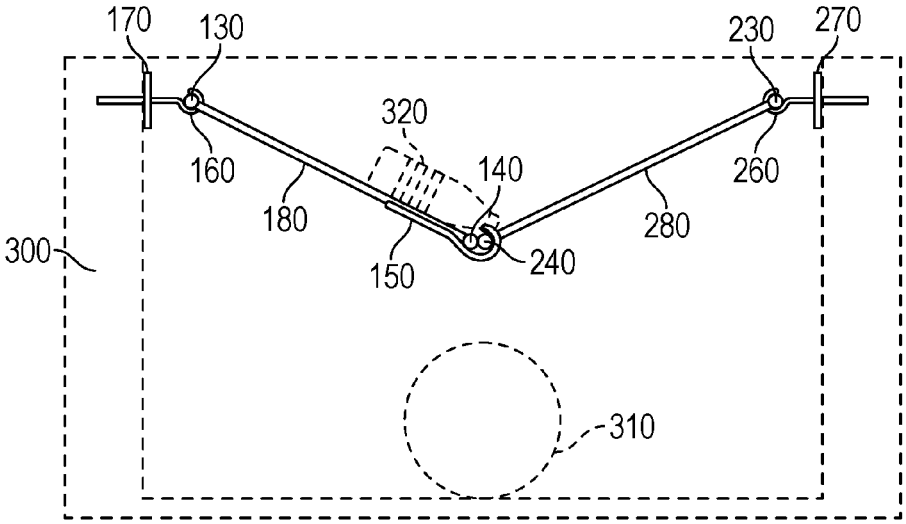
FIG. 4 shows a side elevational view of a filtration apparatus embodying features consistent with the principles of the present disclosure installed in a drainage structure.

The first grate 100 and the second grate 200 each have a plurality of openings therein between their respective proximal and distal sides, as shown in FIGS. 1-3 and 6. The openings within each grate allow stormwater runoff to pass therethrough while filtering debris 320 having dimensions greater than the openings. In this way, the filtration apparatus 10 of the present disclosure reduces the amount of debris 320 that flows into the piping and/or channeling system 310 connected to the bottom of the drainage structure 300, as shown in FIG. 4. Thus, debris 320 that does not reach the piping and/or channeling system 310 will not flow into a water body that may be present at the output of the piping and/or channeling system 310.

The size of the openings within the plurality of openings of each grate may vary from application to application depending on the type of debris 320 desired to be filtered from the stormwater runoff. For instance, to filter out large debris 320, such as plastic bottles, the openings may be larger like those shown in FIGS. 1-3. For applications wherein smaller debris, such as cigarette butts, must be filtered out of the stormwater runoff, smaller openings like those defined by filtration assembly attachments 190 and 290 shown in FIG. 6 may be used. The present disclosure contemplates embodiments wherein the size of the openings comprising the plurality of openings of each grate are the same size, as well as embodiments wherein the size of the openings vary. Additionally, the present disclosure contemplates embodiments wherein the plurality of openings of the first grate 100 are the same size as the plurality of openings of the second grate 200, as well as embodiments wherein the plurality of openings vary in size from grate to grate.

Figure 6:
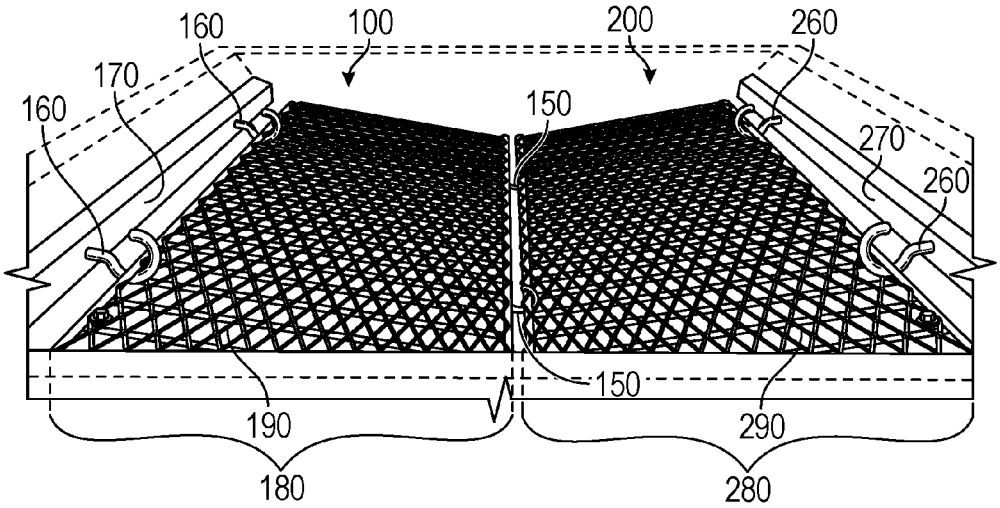
FIG. 6 shows partial perspective view of a filtration apparatus embodying features consistent with the principles of the present disclosure installed in a drainage structure.
Figure 8:
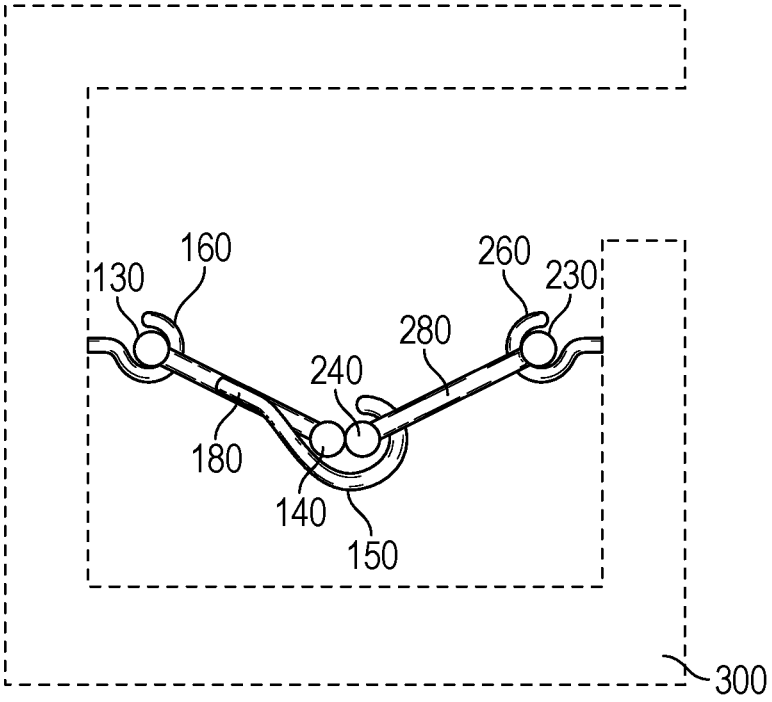
FIG. 8 shows a side elevational view of a filtration apparatus embodying features consistent with the principles of the present disclosure installed in a drainage structure.

The first grate 100 and the second grate 200 of the filtration apparatus 10 are secured in a position within a drainage structure 300 via a first anchoring member 160 and a second anchoring member 260, respectively. As shown in FIGS. 1-3 and 6, depending on the size of the first grate 100, more than one first anchoring member 160 may be used, and depending on the size of the second grate 200, more than one second anchoring member 260 may be used. Preferably, the first anchoring member 160 and second anchoring member 260 are secured at the same level within the drainage structure 300 to provide an angled disposition of the first grate 100 and the second grate 200 when the grates are secured together. However, in some embodiments, the first anchoring member 160 and second anchoring member 260 may be secured at different levels within the drainage structure 300. To prevent the first grate 100 and second grate 200 from blocking the inlet of the drainage structure 300, the first anchoring member 160 and second anchoring member 260 are preferably secured below the inlet of the drainage structure, as best shown in FIGS. 6 and 8.

The first anchoring member 160 is configured to secure the proximal side 110 of the first grate 100 to a first internal wall of a drainage structure 300, and the second anchoring member 260 is configured to secure the proximal side 210 of the second grate 200 to a second internal wall of the drainage structure 300. Preferably, the first internal wall and the second internal wall of the drainage structure 300 are opposite one another. However, the present disclosure contemplates applications wherein the design of a particular drainage structure 300 may require installation of the first grate 100 to a first internal wall that is adjacent or perpendicular to the second internal wall of the drainage structure 300.

Figure 7:
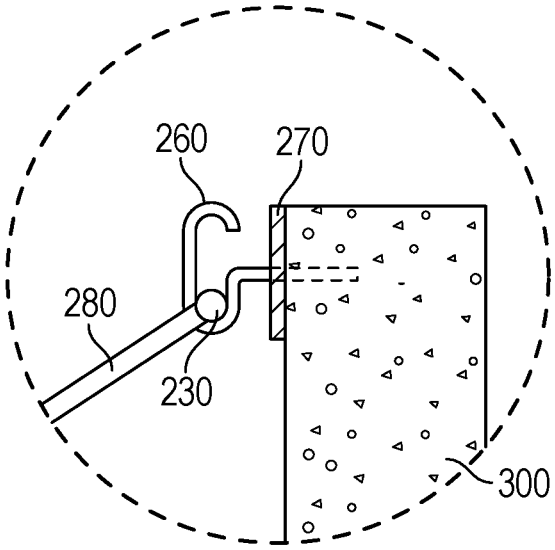
FIG. 7 is a partial view showing an anchoring member, a mounting plate, and a grate embodying features consistent with the present disclosure installed to the interior sidewall of a drainage structure.

To facilitate installment and removal of the first grate 100 and the second grate, the first anchoring member 160 and the second anchoring member 260 are preferably hooks. In this embodiment, the first grate 100 is secured to a first internal wall of the drainage structure 300 by placing the proximal side 110 of the first grate 100 in the gap of the hook serving as the first anchoring member 160, and the second grate 200 is secured to a second internal wall of the drainage structure 300 by placing the proximal side 210 of the second grate 200 in the gap of the hook serving as the second anchoring member 260. Known hooks, such as those shown in FIGS. 1-6 and 8, may be used, or specially manufactured hooks, such as the hook shown in FIG. 7, may be used as first and second anchoring members 160, 260. As shown in FIG. 7, a hook serving as either the first or second anchoring member 160, 260 may be designed to have a first gap and a second gap, the second gap being a mirror image of the first gap in order to prevent the grates from being inadvertently removed or dislodged during use. Although the use of hooks is generally preferred, one of skill in the art should appreciate that alternative securing devices or instruments suitable for securing the first grate 100 and the second grate 200 to the internal walls of a drainage structure 300 may be used without departing from the inventive subject matter disclosed herein. Such alternative securing devices or instruments may include, but are not limited to, nuts and bolts, screws, nails, adhesives, or any combination thereof.

In a preferred embodiment, the first anchoring member 160 and the second anchoring member 260 may be secured directly to an internal wall of the drainage structure 300. In such embodiments, the first and second anchoring members 160, 260 may be embedded within the drainage structure 300 during the casting or manufacture of the drainage structure 300. Alternatively, the first and second anchoring members 160, 260 may be secured to an existing drainage structure 300. Depending on the nature of the drainage structure 300, securing the first anchoring member 160 and the second anchoring member 260 may require drilling one or more holes into the internal walls of the drainage structure 300 and subsequently installing the anchoring members therein. As seen in FIG. 4, the anchoring members 160, 260 may comprise an extended shaft, which may be threaded, that may be installed in a drilled hole in an internal wall of the drainage structure 300 in order to secure the anchoring members 160, 260 to the internal wall of the drainage structure.

In another preferred embodiment, the filtration apparatus 10 may further comprise a first mounting plate 170 and/or a second mounting plate 270. In such embodiments, the first anchoring member 160 is secured to the first internal wall of a drainage structure 300 via the first mounting plate 170, and the second anchoring member 260 is secured to the second internal wall of the drainage structure 300 via the second mounting plate 270, as shown in FIGS. 1, 4, and 6. In instances where more than one first anchoring member 160 and/or more than one second anchoring member 260 are utilized in securing the first grate 100 and second grate 200, respectively, to the internal walls of the drainage structure 300, the use of mounting plates is generally preferred to ensure the proximal side 110 of the first grate 100 and the proximal side 210 of the second grate 200 can be received by their respective anchoring members. The first anchoring members 160 may be secured to the first mounting plate 170 such that the first anchoring members 160 remain in a parallel configuration to each other during installation. The second anchoring members 260 may be secured to the second mounting plate 270 such that the second anchoring members 260 remain in a parallel configuration to each other during installation. A mechanical or laser level may be used to ensure the first mounting plate 170 and the second mounting plate 270 are level before subsequently securing the mounting plates to the internal walls of the drainage structure 300.

Preferably, first anchoring member 160 and second anchoring member 260 are permanently attached to the first mounting plate 170 and second mounting plate 270, respectively. Alternatively, the anchoring members and/or mounting plates may be configured such that the anchoring members are removably secured to a respective mounting plate. The first and second mounting plates 170, 270 may be secured to the drainage structure 300 via bolts, screws, nails, adhesives, or any other device or instrument suitable for holding the first and second mounting plates 170, 270 in a fixed position within the drainage structure 300. Alternatively, the mounting plates 170, 270 may be embedded within the drainage structure 300 during the casting or manufacture of the drainage structure 300. As shown best in FIG. 1, in a preferred embodiment, both the first mounting plate 170 and the second mounting plate 270 are elongated strips of metal.

Figure 5:
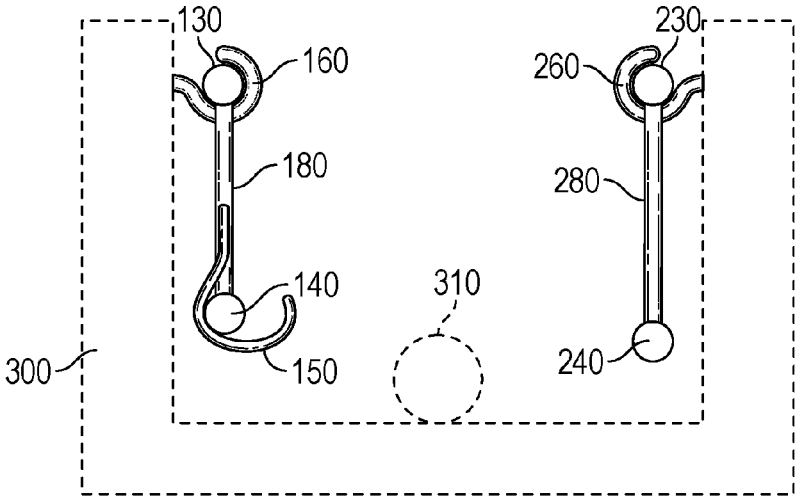
FIG. 5 shows a side view of a filtration apparatus embodying features consistent with the principles of the present disclosure installed in a drainage structure.

As shown in FIG. 5, when secured to the internal walls of the drainage structure 300 and unsecured to one another, the first grate 100 and second grate 200 may hang from the anchoring members 160, 260. Accordingly, when the first grate 100 and the second grate 200 are not secured together, the filtration apparatus 10 retains an open configuration facilitating direct access to piping and/or channeling systems 310 connected to the drainage structure. Conversely, the filtration apparatus 10 may be set in a closed configuration by positioning the distal side of each grate towards the center of the drainage structure 300 and securing the grates together, as shown in FIGS. 1-4, 6, and 8. To change from an open configuration to a closed configuration, or vice versa, the filtration apparatus 10 is preferably designed to permit the first grate 100 and the second grate 200 to swing from a hanging position, as shown in FIG. 5, to a suspended position, as shown in FIG. 4, or vice versa. Preferably, the first anchoring member 160 and the second anchoring member 260 are configured to permit the first grate 100 and second grate 200 to rotate thereupon such that the proximal side of each grate may rotate within a respective anchoring member.

To maintain a closed configuration, the distal side 120 of the first grate 100 and the distal side 220 of the second grate 200 are secured via a connecting member 150. When secured by the connecting member 150, the distal side 120 of the first grate 100 either contacts or is positioned directly adjacent to the distal side 220 of the second grate 200. As shown in FIGS. 1-3 and 6, more than one connecting member 150 may be used to accommodate large grates. To enable the filtration apparatus 10 to change from an open configuration to a closed configuration, or vice versa, it is generally preferred that the connecting member 150 is configured to removably secure the first and second grates 100, 200 about their distal sides. To this end, in a preferred embodiment, the connecting member 150 is a hook attached to the first grate 100, as shown in FIGS. 1-6, and 8. In such embodiments, the hook is configured to pass through an opening within the plurality of openings of the second grate 200 and receive the distal side 220 of the second grate 200 within the gap of the hook, as shown in FIGS. 1-4, 6, and 8. Thus, in such embodiments, the filtration apparatus 10 may be changed from an open configuration to a closed configuration, or vice versa, by placing the distal side 220 of the second grate 200 within the hook or by removing the distal side 220 of the second grate 200 from the hook, respectively.

Although the use of a hook as the connecting member 150 is preferred, one of skill in the art should appreciate that any securing device or instrument configured to removably secure two objects including, but not limited to, nuts and bolts, hook and loop fasteners, latches, clasps, snap buttons, or string may alternatively be used. The connecting member 150 is preferably permanently attached to the first grate 100, but alternatively may be removably secured thereto. In a preferred embodiment, the connecting member 150 is configured to allow the second grate 200 to rotate thereupon or therein such that the distal side 220 of the second grate 200 may rotate within or on the connecting member 150.

The filtration apparatus 10 is designed such that when placed in a closed configuration, the first grate 100 and the second grate 200 substantially bisects the internal cavity of the drainage structure 300, as best shown in FIGS. 1-2 and 4. Thus, the shape and size of the first grate 100 and of the second grate 200 may vary, depending on the dimensions of the drainage structure 300 in which the filtration apparatus 10 is installed. Accordingly, the first grate 100 and second grate 200 may be circular, square, trapezoidal, triangular, or any similar shape suited to fit the dimensions of the drainage structure 300. For instance, as shown in FIGS. 1-3, the first grate 100 and the second grate 200 may both be rectangular in shape to accommodate drainage structures 300 having a generally rectangular-shaped internal cavity. The shape of first grate 100 and the shape of the second grate 200 may be the same shape or varied.

The distance between the proximal side 110 and the distal side 120 of the first grate 100 defines the width of the first grate 100, and the distance between the proximal side 210 and the distal side 220 of the second grate 200 defines the width of the second grate 200. The widths of the first grate 100 and the second grate 200 may be equal or varied. Moreover, the length of the first grate 100 and the length of the second grate 200 may be the same or varied. Preferably, the first grate 100 and second grate 200 are of sufficient widths such that when the filtration apparatus 10 is in a closed configuration, each grate angles downwardly from its proximal side to its distal side toward the center of the drainage structure 300. In a preferred embodiment, the combined width of the first grate 100 and the second grate 200 is greater than the width of the drainage structure 300. As best shown in FIG. 4, in such embodiments, the first grate 100 and second grate 200 may form a generally "V-shaped" structure within the drainage structure 300, thereby causing debris 320 caught by the filtration apparatus 10 to slide and subsequently accumulate near the center of the filtration apparatus 10 where the distal sides of the grates are secured together.

Because stormwater runoff is not generally projected towards the center of the drainage structure 300 upon entry, angling the first grate 100 and second grate 200 in this manner serves to reduce or prevent debris 320 filtered by the filtration apparatus 10 from blocking the flow of stormwater runoff. Moreover, debris 320 captured by the filtration apparatus 10 is unlikely to escape the drainage structure due to the force of incoming stormwater runoff Thus, the filtration apparatus 10 may reduce the frequency of drainage system clogs and may effectively captures debris 320 without reducing the volume of stormwater runoff that may enter the drainage structure 300.

In a preferred embodiment, the first grate 100 comprises a proximal support member 130, a distal support member 140, and a filtration assembly 180, and the second grate 200 comprises a proximal support member 230, a distal support member 240, and a filtration assembly 280. As best shown in FIGS. 1 and 3, the proximal support member 130 of the first grate 100 defines the first grate's 100 proximal side 110, and the proximal support member 230 of the second grate 200 defines the second grate's 200 proximal side 210. Thus, in such embodiments, the first grate 100 is secured by its proximal support member 130 to a first internal wall of the drainage structure 300 via the first anchoring member 160, and the second grate 200 is secured by its proximal support member 230 to a second internal wall of the drainage structure 300 via the second anchoring member 260. As shown in FIGS. 1 and 3-4, each proximal support member 130, 230 is preferably substantially the same length as the internal wall of the drainage structure 300 to which it is secured. To facilitate rotation of the first grate 100 and the second grate 200 about the anchoring members 160, 260, the proximal support member of each grate is preferably rounded, as best shown in FIGS. 4-5 and 7-8.

The distal support member 140 of the first grate 100 defines the distal side 120 of the first grate 100, and the distal support member 240 of the second grate 200 defines the distal side 220 of the second grate. In such embodiments, the connecting member 150 secures the first grate 100 to the second grate 200 such that the distal support member 140 of the first grate 100 contacts or is positioned directly adjacent to the distal support member 240 of the second grate 200. As shown in FIGS. 1 and 3-4, each distal support member 140, 240 is preferably substantially the same length as the proximal support members 130, 230. To facilitate rotation of the second grate 200 about the connecting member 150, the distal support member 240 of the second grate 200 is preferably rounded, as best shown in FIGS. 4-5 and 7-8.

The filtration assembly 180 is secured to the proximal support member 130 and to the distal support member 140 of the first grate 100, and the filtration assembly 280 is secured to the proximal support member 230 and to the distal support member 240 of the second grate 200. The filtration assembly 180 of the first grate 100 defines the plurality of openings within the first grate 100, and the filtration assembly 280 of the second grate 200 defines the plurality of openings within the second grate 200. In a preferred embodiment, the filtration assembly 180 of the first grate 100 and the filtration assembly 280 of the second grate 200 each comprise a plurality of elongated members secured to the proximal support members 130, 230 and to the distal support members 140, 240 of the first and second grates, as shown in FIGS. 1-3. In a preferred embodiment, the diameter of the plurality of elongated support members is smaller than the diameter of the proximal and distal support members, as shown best in FIGS. 1-3.

To adjust the dimensions of the plurality of openings within each grate to regulate the size of debris 320 filtered out of the incoming stormwater runoff, the plurality of elongated members may be manipulated. For instance, the plurality of openings of each grate may be made larger or smaller by adding or removing elongated members or by adjusting the spacing of the elongated members. In one preferred embodiment, each elongated member of the plurality of elongated members of each grate are arranged parallel and adjacent to another elongated member. Alternatively, the filtration assembly 180 of the first grate 100 and the filtration assembly 280 of the second grate 200 may be a lattice. In alternative embodiments, the filtration assembly 180 of the first grate 100 and the filtration assembly 280 of the second grate 200 may utilize different structures to define the plurality of openings for each grate. For instance, in one embodiment, the filtration assembly 180 of the first grate 100 may comprise a plurality of elongated members while the filtration assembly 280 of the second grate 200 may comprise a lattice.

To enable adjustment of the filtration apparatus 10 to filter out larger or smaller debris from incoming stormwater runoff, the first grate 100, the second grate 200, or both, may further comprise a filtration assembly attachment 190, 290, as shown in FIG. 6, which may be attached to the filtration assembly 180, 280 of the first grate 100 or the second grate 200. The filtration assembly attachment 190 of the first grate 100 defines a plurality of openings having a diameter smaller than the plurality of openings defined by the filtration assembly 180 of the first grate 100. The filtration assembly attachment 290 of the second grate 200 defines a plurality of openings having a diameter smaller than the plurality of openings defined by the filtration assembly 280 of the second grate 200. Accordingly, the size of debris 320 the filtration apparatus 10 filters out of incoming stormwater runoff may be adjusted by securing filtration assembly attachments to, or removing filtration assembly attachments from, the filtration assemblies 180, 280 of the first and second grates 100, 200. As shown in FIG. 6, in one embodiment, the filtration assembly attachment 190 of the first grate 100 and the filtration assembly attachment 290 of the second grate 200 are each a lattice.

Preferably, the filtration assembly attachment 190 of the first grate 100 and the filtration assembly attachment 290 of the second grate 200 are removably secured to the filtration assembly 180 of the first grate 100 and the filtration assembly 280 of the second grate 200, respectively. As shown in FIG. 6, in a preferred embodiment, the filtration assembly attachment 190 of the first grate 100 and the filtration assembly attachment 290 of the second grate 200 may be removably secured via a combination of nuts, bolts, and washers. However, one of skill in the art should appreciate that the filtration assembly attachment 190 of the first grate 100 and the filtration assembly attachment 290 of the second grate 200 may be secured by any instrument or device suitable for removably securing one object to another.

The dimensions of each structural element of the filtration apparatus 10 may be designed to correspond to the dimensions of any drainage structure 300. The filtration apparatus 10 of the present disclosure may find applications in drainage structures 300 including, but not limited to, catch basins, manholes, junction boxes, or any other similar structures. Accordingly, the filtration apparatus 10 of the present disclosure may be designed to retrofit an existing drainage structure 300 or may be designed for installation within a newly cast or manufactured drainage structure 300. Moreover, because the filtration apparatus 10 is secured in place utilizing the internal walls of a drainage structure 300, the filtration apparatus 10 may be used in place of or in addition to pre-existing filtration devices within a drainage structure 300, such as an inlet grate. Additionally, the filtration apparatus 10 may be utilized in drainage structures having a horizontal inlet, as shown in FIGS. 1-6, as well as drainage structures having vertical inlets, as shown in FIG. 8.

Because the filtration apparatus 10 may be subject to large volumes of liquid during use, it is preferred that the structural elements of the filtration apparatus 10 be constructed of stainless steel. However, one of skill in the art will readily appreciate that other materials may be used without departing from the inventive subject matter of the present disclosure. Other suitable materials may include, but are not limited to, galvanized steel, carbon steel, aluminum, fiberglass, plastic, wood, or rubber. The structural elements of the filtration apparatus 10 may all be made of the same type of material or of different materials.

In another aspect, the present disclosure is directed toward a method for installing an apparatus for use with drainage structures. To install the filtration apparatus 10 of the present disclosure within a drainage structure 300, the first anchoring member 160 is secured to a first internal wall of a drainage structure 300, and the second anchoring member 260 is secured to a second internal wall of the drainage structure 300. Once the anchoring members 160, 260 are secured in place, the proximal side 110 of the first grate 100 is secured to the first internal wall of the drainage structure 300 via the first anchoring member 160, and the proximal side 210 of the second grate 200 is secured to the second internal wall of the drainage structure 300 via the second anchoring member 260. To complete installation of the filtration apparatus 10, the distal side 120 of the first grate 100 is secured to the distal side 220 of the second grate 200 via the connecting member 150. In some embodiments, the distal side 120 of the first grate 100 and the distal side 220 of the second grate 200 may be secured by placing the distal support member 240 of the second grate 200 within the connecting member 150.

It is understood that versions of the inventive subject matter of the present disclosure may come in different forms and embodiments. Additionally, it is understood that one of skill in the art would appreciate these various forms and embodiments as falling within the scope of the inventive subject matter disclosed herein.

What is claimed is:

1. A filtration apparatus for drainage structures, comprising:

a first grate having a proximal side and a distal side;

a second grate having a proximal side and a distal side;

a connecting member configured to removably secure the distal side of the first grate to the distal side of the second grate, wherein the first grate and the second grate each have a plurality of openings therein;

a first anchoring member configured to secure the proximal side of the first grate to a first wall of a drainage structure; and a second anchoring member configured to secure the proximal side of the second grate to a second wall of the drainage structure, wherein the apparatus has a first width extending from the proximal side to the distal side of the first grate and a second width extending from the proximal side to the distal side of the second grate, the combined width of the first width and the second width being greater than the width of the drainage structure.

2. The apparatus of claim 1, wherein the connecting member is a hook permanently attached to the first grate.

3. The apparatus of claim 1, wherein the connecting member is further configured to permit the second grate to rotate thereupon.

4. The apparatus of claim 1, wherein the first anchoring member is further configured to permit the first grate to rotate thereupon, and the second anchoring member is further configured to permit the second grate to rotate thereupon.

5. The apparatus of claim 1, wherein the first grate and the second grate each comprise:

a proximal support member defining the proximal side;

a distal support member defining the distal side; and a filtration assembly secured to the proximal support member and to the distal support member, wherein the filtration assembly defines the plurality of openings in each grate.

6. The apparatus of claim 5, wherein the filtration assembly of the first grate and the filtration assembly of the second grate each comprise a plurality of elongated members secured to the proximal support member and to the distal support member of each respective grate.

7. The apparatus of claim 5, wherein at least one grate of the apparatus further comprises a filtration assembly attachment removably secured to the filtration assembly of the at least one grate, wherein the filtration assembly attachment defines a plurality of openings, and wherein the plurality of openings defined by the filtration assembly attachment have a diameter smaller than the plurality of openings defined by the filtration assembly of the at least one grate.

8. The apparatus of claim 1, wherein the length of the first grate is equal to the length of the second grate.

9. The apparatus of claim 1, wherein the first width and the second width are equal.

10. The apparatus of claim 1, further comprising a first mounting plate configured to secure the first anchoring member to the first wall of the drainage structure and a second mounting plate configured to secure the second anchoring member to the second wall of the drainage structure.

11. A filtration apparatus for drainage structures, comprising:

a first grate comprising:

a proximal support member, a distal support member, and a filtration assembly, wherein the filtration assembly is secured to the proximal support member and to the distal support member, and wherein the filtration assembly defines a plurality of openings;

a second grate comprising, a proximal support member, a distal support member, and a filtration assembly, wherein the filtration assembly is secured to the proximal support member and to the distal support member, and wherein the filtration assembly defines a plurality of openings;

a connecting member configured to removably secure the distal support member of the second grate to the distal support member of the first grate;

a first anchoring member configured to secure the proximal support member of the first grate to a first wall of a drainage structure; and a second anchoring member configured to secure the proximal support member of the second grate to a second wall of the drainage structure, wherein the apparatus has a first width extending from the proximal side to the distal side of the first grate and a second width extending from the proximal side to the distal side of the second grate, the combined width of the first width and the second width being greater than the width of the drainage structure.

12. The apparatus of claim 11, wherein the first anchoring member is further configured to permit the proximal support member of the first grate to rotate thereupon, and the second anchoring member is further configured to permit the proximal support member of the second grate to rotate thereupon.

13. The apparatus of claim 11, further comprising a first mounting plate configured to secure the first anchoring member to the first wall of the drainage structure and a second mounting plate configured to secure the second anchoring member to the second wall of the drainage structure.

14. The apparatus of claim 11, wherein the connecting member is permanently attached to the first grate.

15. The apparatus of claim 14, wherein the connecting member is further configured to permit the distal support member of the second grate to rotate thereupon.

16. The apparatus of claim 11, wherein the filtration assembly of the first grate and the filtration assembly of the second grate each comprise a plurality of elongated members, each elongated member of the plurality of elongated members being arranged parallel and adjacent to another elongated member of the plurality of elongated members.

17. The apparatus of claim 11, wherein at least one grate of the apparatus further comprises a filtration assembly attachment removably secured to the filtration assembly of the at least one grate, wherein the filtration assembly attachment defines a plurality of openings, and wherein the plurality of openings defined by the filtration assembly attachment have a diameter smaller than the plurality of openings defined by the filtration assembly of the at least one grate.

18. A method for installing a filtration apparatus for use with drainage structures, said method comprising the steps of:

providing an apparatus for drainage structures, said apparatus comprising:

a first grate having a proximal side and a distal side;

a second grate having a proximal side and a distal side; and a connecting member configured to removably secure the distal side of the first grate to the distal side of the second grate, wherein the first grate and the second grate each have a plurality of openings therein;

a first anchoring member configured to secure the proximal side of the first grate to a first wall of a drainage structure; and a second anchoring member configured to secure the proximal side of the second grate to a second wall of the drainage structure, wherein the apparatus has a first width extending from the proximal side to the distal side of the first grate and a second width extending from the proximal side to the distal side of the second grate, the combined width of the first width and the second width being greater than the width of the drainage structure;

securing the first anchoring member to the first wall of the drainage structure;

securing the second anchoring member to the second wall of the drainage structure;

securing the proximal side of the first grate to the first wall of the drainage structure via the first anchoring member;

securing the proximal side of the second grate to the second wall of the drainage structure via the second anchoring member; and securing the distal side of the first grate to the distal side of the second grate via the connecting member.

19. The method of claim 18, wherein the first grate comprises:

a proximal support member defining the proximal side, a distal support member defining the distal side, and a filtration assembly defining the plurality of openings of the first grate; and wherein the second grate comprises:

a proximal support member defining the proximal side, a distal support member defining the distal side, and a filtration assembly defining the plurality of openings of the second grate; and wherein the connecting member is permanently attached to the first grate, and the connecting member is configured to receive the distal support member of the second grate therein; and wherein the step of securing the distal side of the first grate to the distal side of the second grate via the connecting member comprises:

placing the distal support member of the second grate within the connecting member.

* * * * *